US006142892A

United States Patent [19]

Dennis

[11] Patent Number: 6,142,892

[45] Date of Patent: Nov. 7, 2000

[54] NET SECURING DEVICE

[76] Inventor: John Dennis, Post Office Road, Lusk, County Dublin, Ireland

[21] Appl. No.: 09/171,808

[22] PCT Filed: Apr. 13, 1997

[86] PCT No.: PCT/IE97/00032

§ 371 Date: Oct. 22, 1998

§ 102(e) Date: Oct. 22, 1998

[87] PCT Pub. No.: WO97/39807

PCT Pub. Date: Oct. 30, 1997

[51] Int. Cl.[7] ..... A63B 61/00; F16L 3/08

[52] U.S. Cl. ..... 473/494; 473/491; 473/477; 248/74.3

[58] Field of Search ..... 24/173, 182, 457, 24/466, 518, 510, 530, 601.7, 645, 710.7, 519, 16 PB; 273/407; 473/446, 470, 471, 485, 489, 491, 492, 494, 197; 248/74.3, 499, 221.12, 224.7, 225.11

[56] References Cited

U.S. PATENT DOCUMENTS

| | | | |
|---|---|---|---|
| 1,968,720 | 7/1934 | Staff | 273/30 |
| 3,807,675 | 4/1974 | Seckerson et al. | 248/73 |
| 3,878,589 | 4/1975 | Schaefer | 248/225.11 |
| 4,250,601 | 2/1981 | Ward | 248/225.11 |
| 4,458,869 | 7/1984 | Mayo | 248/225.11 |
| 4,826,193 | 5/1989 | Davis | 248/499 |
| 4,929,116 | 5/1990 | Mahl | 248/225.11 |
| 5,026,016 | 6/1991 | Lisowski | 248/225.11 |
| 5,035,389 | 7/1991 | Wang | 248/225.11 |
| 5,513,421 | 5/1996 | Wells | 24/16 PB |
| 5,524,883 | 6/1996 | Allen et al. | 473/485 |
| 5,571,266 | 11/1996 | Nichols | 273/400 |
| 5,651,552 | 7/1997 | Whelchel | 473/494 |
| 5,664,294 | 9/1997 | Sorensen | 24/16 PB |
| 5,664,784 | 9/1997 | Redlich et al. | 473/476 |
| 5,675,870 | 10/1997 | Cooper | 24/16 PB |
| 5,816,954 | 10/1998 | Zheng | 473/471 |
| 5,857,928 | 1/1999 | Stewart | 473/446 |
| 5,902,194 | 5/1999 | Wade | 473/446 |

*Primary Examiner*—Jessica J. Harrison
*Assistant Examiner*—Dolores R. Collins

[57] ABSTRACT

A net fixing device for goalposts and other structures used in games and comprising a male member and a cooperating female member, one member being for permanent fixing to the goalpost and the other being for fixing to the net. Preferably, the female member is for fixing to the goalpost and the male member is for fixing to the net. The male member and the female member are interengagable to form a ball and socket joint. The female member may comprise a base plate which mounts a body member incorporating a socket, and having an open elongated slot in the body member projecting inwardly of a mouth of the socket. The male member may comprise a shank for engaging the slot and terminating in a bulbous head for engagement of the socket and in which the shank includes attachment means for a net.

18 Claims, 8 Drawing Sheets

12
5
13
10
23

5

6a
8
7
22
21
6

62
8
6
4
4
21

21
7
8
6
6a

NET SECURING DEVICE

This invention relates to a connector and in particular to a net fixing device for goalposts and other structures used in games.

There are major safety problems with goalposts used in football, hurling, hockey, soccer and other ball games in that in many instances nets have been attached to the posts by the use of metal hooks or some other form of permanent fixtures. Injuries to players have been commonplace on coming into contact with such fixing devices. Because of the increased emphasis on safety, the ruling authorities in many games have banned many of these fixing devices.

Various net fixing devices are known. For example, French Patent Application No. 2707507 discloses goalposts and a cross-bar which are made from an aluminium section having a groove of predetermined depth which allows the introduction of an aluminium T-piece for fixing the netting on the posts and the bar with concealed hooks. Unfortunately such a device is extremely expensive to make as, it requires extremely expensive posts and cross-members and generally is not very efficient in use.

U.S. Pat. No. 5,476,266 discloses a net fastener device for securing a net to a soccer goal frame. Essentially a plurality of spaced-apart clips and hangers are provided around an edge of the net, the clips and hangers being engagable in associated channels or tracks fixed along a rear face of the goal upright and the crossbar respectively.

European Patent Publication No. 502279 discloses another construction of post which are made in light metal and oval in section provided with internal stiffening members. A central groove on one wall of the post holds a nut into which a threaded rod is put to secure a hook to fix the net to the hook. Unfortunately such a hook provides a hazard for the players. Other proposals, for example, have been the use of VELCRO (Registered Trade Mark) Straps as disclosed for example in PCT patent publication no. WO95/00214. Undoubtedly VELCRO Straps superficially appears to be a good way to provide such fixing since VELCRO is easily removed and refitted. Unfortunately, as everybody is aware, nets are not stored in perfect conditions, nets get contaminated and dirty and the VELCRO quickly loses its effectiveness.

There is indeed a need to provide a more efficient way of fixing nets to goalposts which obviates the need of tapes, wire wraps, straps, cord, etc. It is vital that any such fixing device should not alone be easy to use, but should be easily removed, because if not they will be torn off by those taking the nets down at the end of a match.

Essentially what is required is a safe, simple, time-saving, durable and economic net fixture. Such a safe fixture must ensure that there are no sharp projections to catch clothing or body and that all external surfaces and edges are smooth. Secondly, it must be simple in that any complicated attachments or complicated pieces of equipment of their nature are difficult to use. It must be time-saving in that the attachment and the removal of the net must be simple and easy. The devices must be durable because if not, they are of little use and they must be both weatherproof and vandal-proof. Finally, the components of the particular device must be capable of mass production and be maintenance-free so that they can be cheaply and easily produced and will last sufficient time to make the purchase economic.

According to the invention there is provided a net fixing device for goalposts and other structures used in games comprising a male member and a cooperating female member, one member for permanent fixing to the goalpost and the other for fixing to the net. Preferably, the female member is for fixing to the goalpost and the male member is for fixing to the net.

Such a device overcomes the major problems of all heretofore known net fixing devices in that what is provided are two easily cooperating pieces of equipment that can be engaged and disengaged relatively easily.

In a particularly preferred embodiment the male member and the female member are interengagable to form a ball and socket joint. This advantageously allows secure engagement of the male member and female member in use.

In one embodiment of the invention the female member comprises a base plate mounting a body member incorporating a socket, having an open elongated slot in the body member projecting inwardly of a mouth of the socket and in which the male member comprises a shank for engaging the slot and terminating in a bulbous head for engagement of the socket and in which the shank includes attachment means for a net. By the use of an open socket of this construction the net can be relatively easily mounted on the posts by simply slipping the male member into each female member while it can be removed almost by an "unzipping" action in the sense that once they start to be pulled upwards and away from the slot, they will all be pulled in the one direction and all the male members will quickly fall away releasing the net.

In a still further embodiment of the invention the bulbous head is rounded or a semi-sphere shape and in this embodiment a complementary cooperating underside surface of the adjacent slot of the female member is arcuate. This configuration forms a ball and socket joint when the male and female members are interengaged. A cup is formed in the female member for reception of the rounded head. This arrangement advantageously provides a secure engagement of the male and female members in use, retaining the male member in engagement with the female member. This configuration allows relative smooth movement between the male and female members when any force is placed on the head such as when a ball is driven into the net or a player falls against it. This ensures that the net will not be torn and it provides added safety and will control the bounce of the ball against the net.

In another embodiment the bulbous head is a disc having a flat rear face for engagement with an inner face of the socket. In this arrangement preferably the head is an interference fit in the socket or some other means is provided to retain the head in engagement with the socket in use.

In a preferred embodiment the flange is provided on the shank spaced-apart from the head, said flange being of greater width than the slot, portion of the shank between the head and the flange being engagable with the slot.

In another embodiment the male member is an interference fit with the female member.

In a further embodiment the attachment means is releasable. Alternatively, the attachment means may be lockable on the net.

Conveniently the attachment means used to connect the shank to the net can be a length of cord or a flexible strap incorporating strap locking means. It is also envisaged that the shank might incorporate some form of plastics snap-on fitting to obviate the need for a flexible connector.

In a particularly preferred embodiment the strap locking means comprises a buckle mounted at an inner end of the shank, the buckle having an eye for through passage of free end of the strap, a strap retaining structure mounted within the eye for engagement with complementary teeth on the strap when the strap is drawn through the eye of the buckle.

In a further embodiment net gripping means is provided on the strap. Conveniently the net gripping means comprises grip projections on the strap which are engagable with the net when the strap is mounted on the net. This conveniently prevents movement of the strap on the net.

Preferably figure grip means is provided on the shank to facilitate gripping the shank. The figure grip means may comprise a polarity of upstanding ribs on the shank.

In a further embodiment there is provided a net fixing device for releasable securing a net on a support such as a goalpost of like, the net fixing device comprising;

a male member;

a female member for incorporating with the male member;

the male and female members having complementary interengagable formations for releasable engagement of the male member with the female member;

means for permanently fixing one member to the goalpost; and means for fixing the other member to a net.

In a preferred embodiment the female member comprises a base plate having means for fixing the base plate to the goalpost.

A body member on the base plate having a socket for reception of the male member.

A side wall of the socket having a slot.

The male member comprising a shank which is slidable engagable within the slot.

The shank having an inner end and an outer end.

A bogus head at the outer end of the shank. The head engagable with the socket.

Attachment means at the inner end of the shank for engagement with the net.

In another aspect the invention provides a net mounting kit comprising a plurality of the net fixing devices as claimed in any preceding claim. Typically the kit would comprise sufficient of the devices for mounting either one net on one set of goalposts or more preferably two nets on two sets of goalposts.

In a further embodiment the net mounting kit further includes a holder having means to engage and support a male member of the net fixing device to engage the male member with or release the male member from the female member. This conveniently assists the mounting of the net on the goalpost and practically on the cross bar of the goalpost.

Preferably the holder has a forked head for engagement with the shank of the male member.

Conveniently, the holder has a socket for mounting the holder on a pole. Thus for example the holder could be conveniently mounted and a free end of a broomhandler. The invention will be more clearly understood from the following description of some embodiments thereof, given by way of example only with reference to the accompanying drawings in which.

Figure 1:
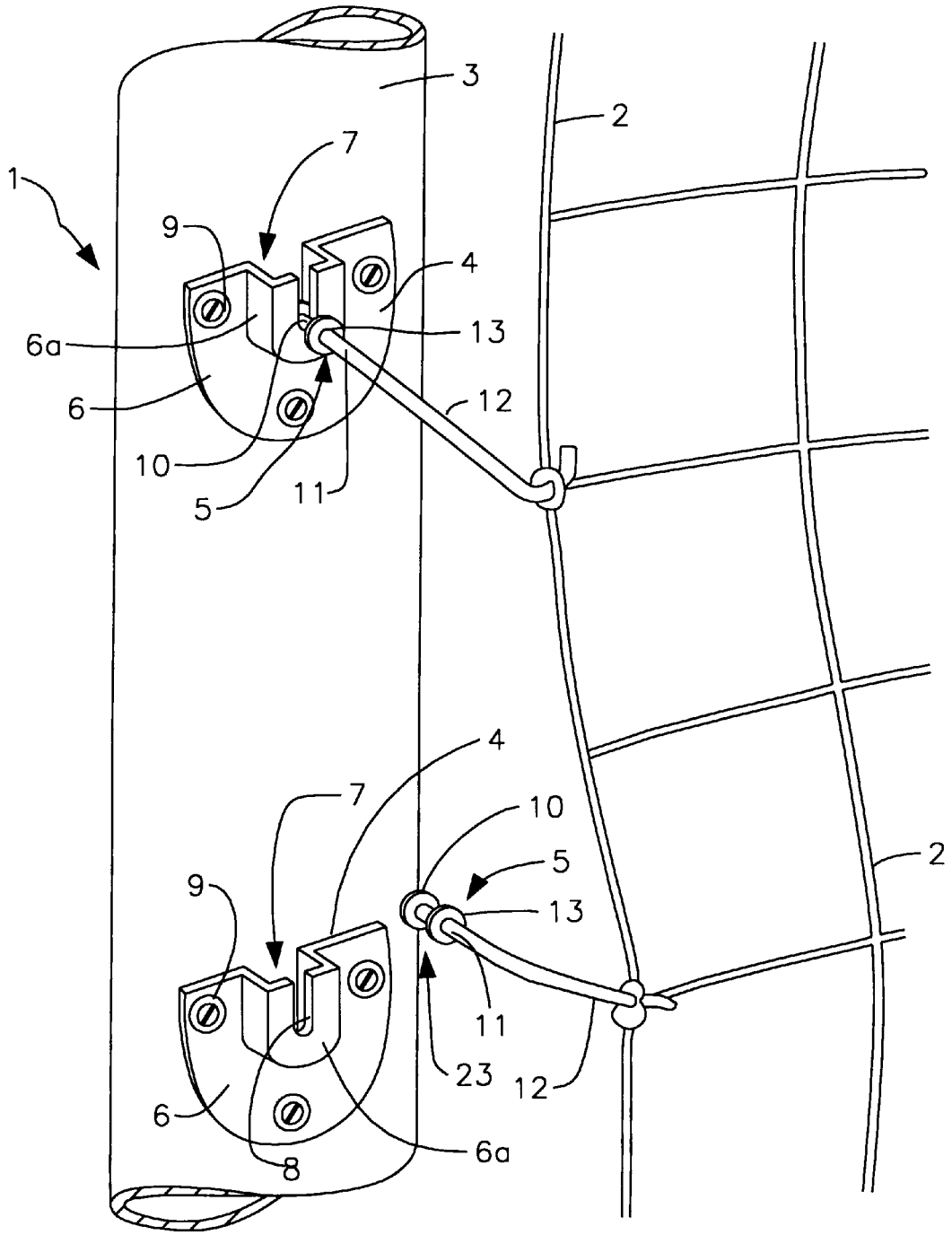
FIG. 1 is a perspective view of portion of a goalpost and a net fixing device according to the invention.
Figure 2:
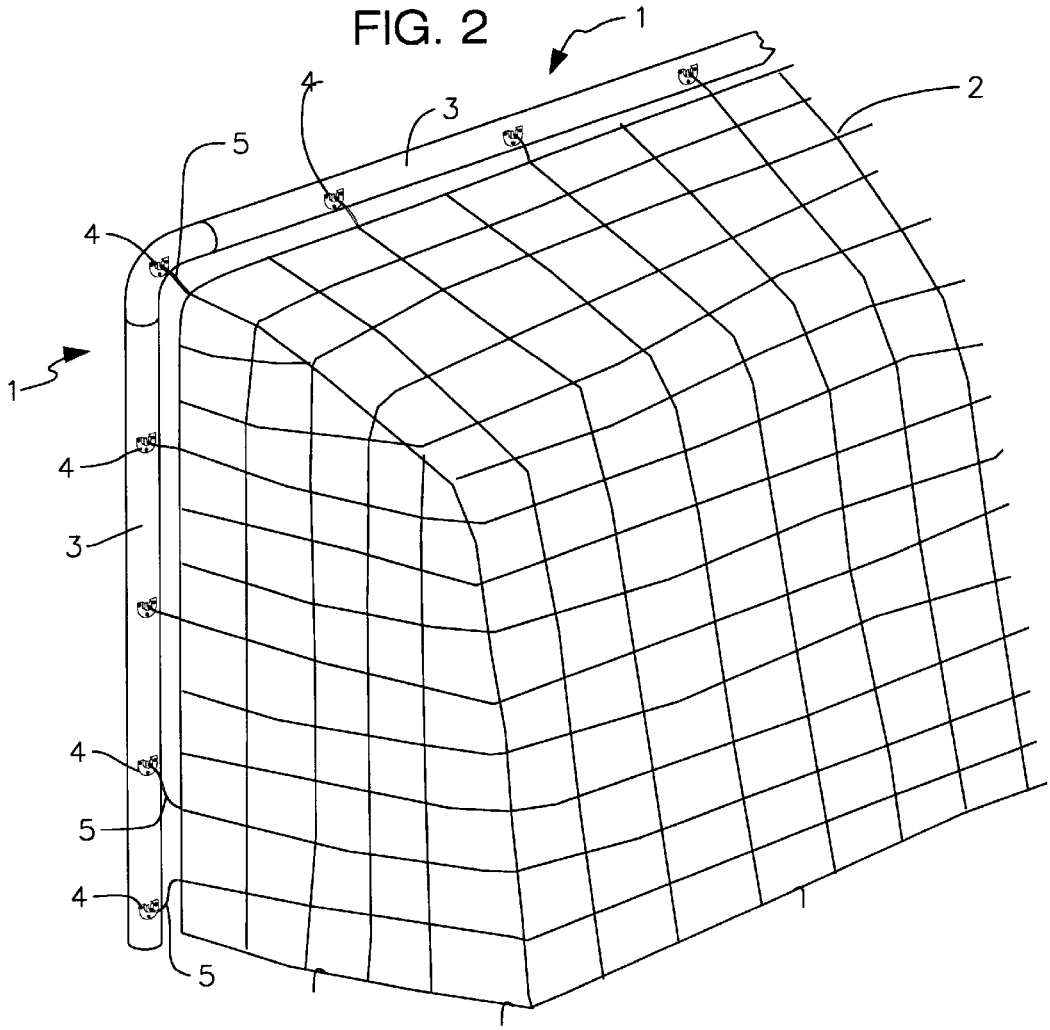
FIG. 2 is a view of part of a goalpost with the net assembled.

Referring to the drawings and initially to FIGS. 1 and 2 thereof, there is illustrated a net fixing device, according to the invention, indicated generally by the reference numeral 1 mounting a net 2 on a goalpost 3. The net fixing device 1 comprises a female member 4 and a male member 5. The female member 4 comprises a base plate 6 with a body member 6*a* incorporating a socket 7, having an open elongated slot 8 projecting inwardly of the socket mouth. It will be seen that the base plate 6 is mounted on the goalpost 3 by screws 9 or rivets which engage associated holes in the base plate 6. The male member 5 comprises a bulbous head 23 formed from a pair of circular plates 10, 13 mounted on a shank 11 to which is connected a length of cord 12. The outer plate 10 is engagable with the socket 7.

In use, when the male member 5 is connected by the cord 12 to the net 2, once the male member is offered up to the slot 8 and engages within the socket 7, the net is securely connected to the goalpost 3. This is clearly illustrated in FIGS. 1 and 2. When it is desired to remove the net from the goalpost, it is a simple matter to pull or knock the cord 12 upwards, disengaging the male member 5 from the female member 4.

Referring to FIGS. 3 to 7 there is illustrated an alternative construction of net fixing device, comprising a male member indicated generally by the reference numeral 20 and a female member indicated generally by the reference numeral 21. Parts similar to those described with reference to the previous drawings are identified by the same reference numerals. In this embodiment the female member 21 has adjacent the slot 8 on the underneath surface thereof an arcuate surface 22 forming a cupped inner end of the socket 7 and this cooperates with a spherical surface forming portion 10 of a bulbous head 23 on the male member 20. This effectively forms a ball and socket joint when the male and female members are engaged for secure engagement. An advantage of this arcuate surface and cooperating semi-spherical shaped portion 10 of the bulbous head 23 is that there is relative movement in a smooth way between the female member and the male member under any form of impact on the net 2.

Figures 3, 4, 5, 6, 7:
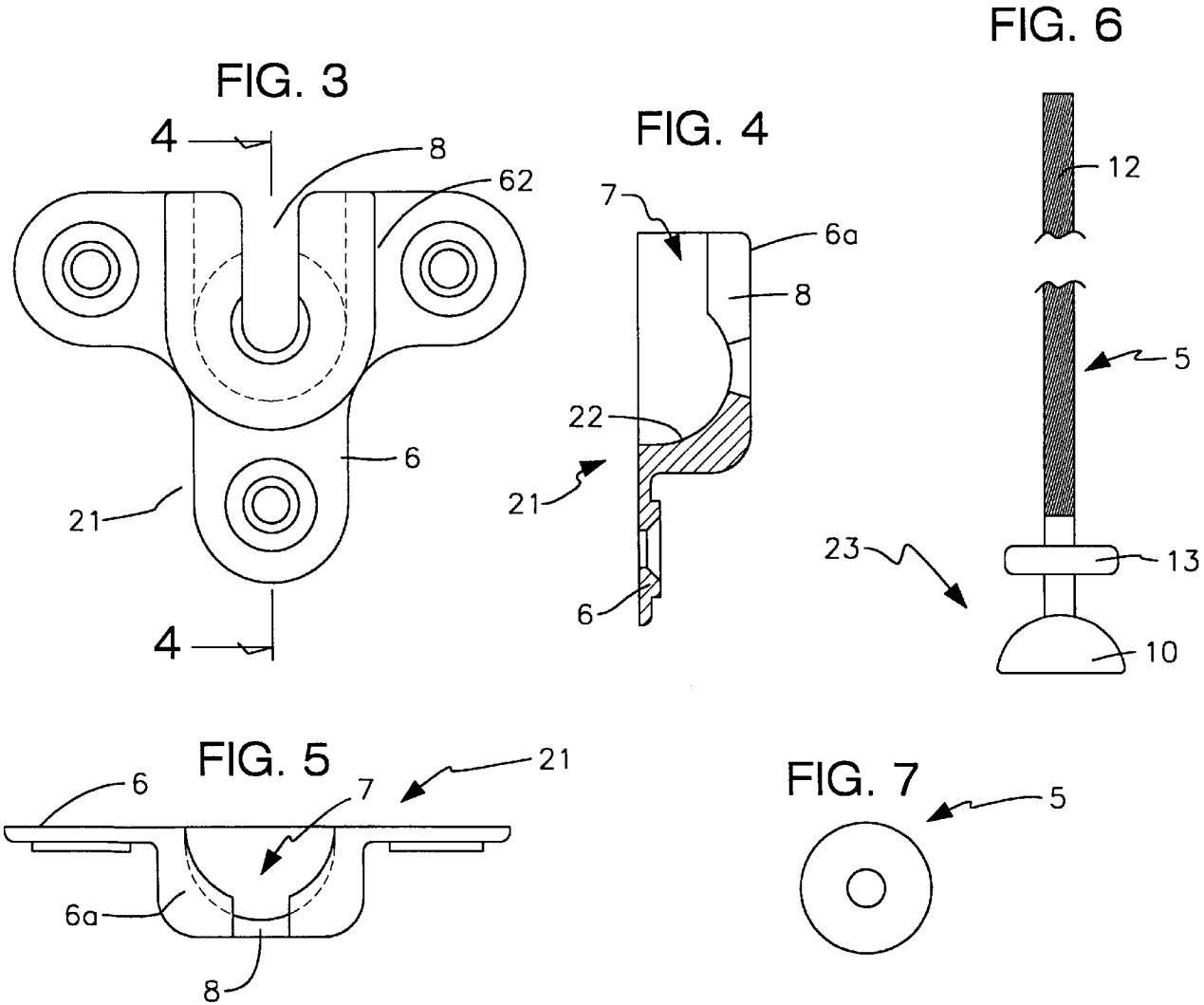
FIG. 3 is an elevational view of a female member forming part of an alternative construction of net fixing device according to the invention.
FIG. 4 is a side cross-sectional view of the female member of FIG. 3 along the lines IV—IV of FIG. 3.
FIG. 5 is a plan view of the female member of FIG. 3.
FIG. 6 is a side view of a male member for use with the female member of FIG. 3.
FIG. 7 is an end view of the male member of FIG. 6.
Figure 9:
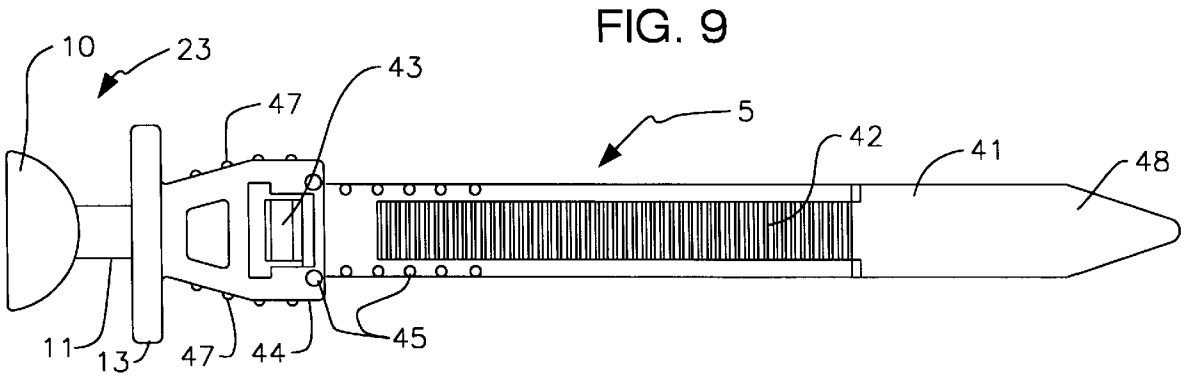
FIG. 9 is a plan view of the male member of FIG. 8.
Figure 8:
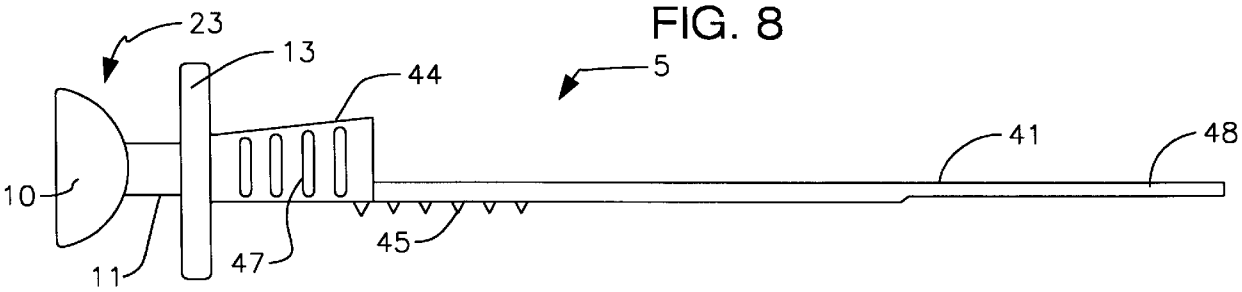
FIG. 8 is an elevational view of an alternative construction of male member according to the invention.
Figure 10:
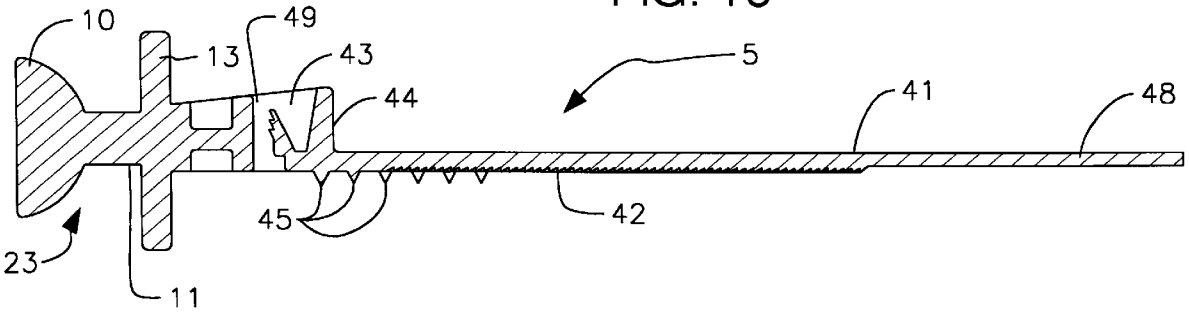
FIG. 10 is a typical cross-sectional view of the male member of FIG. 8
Figure 11:
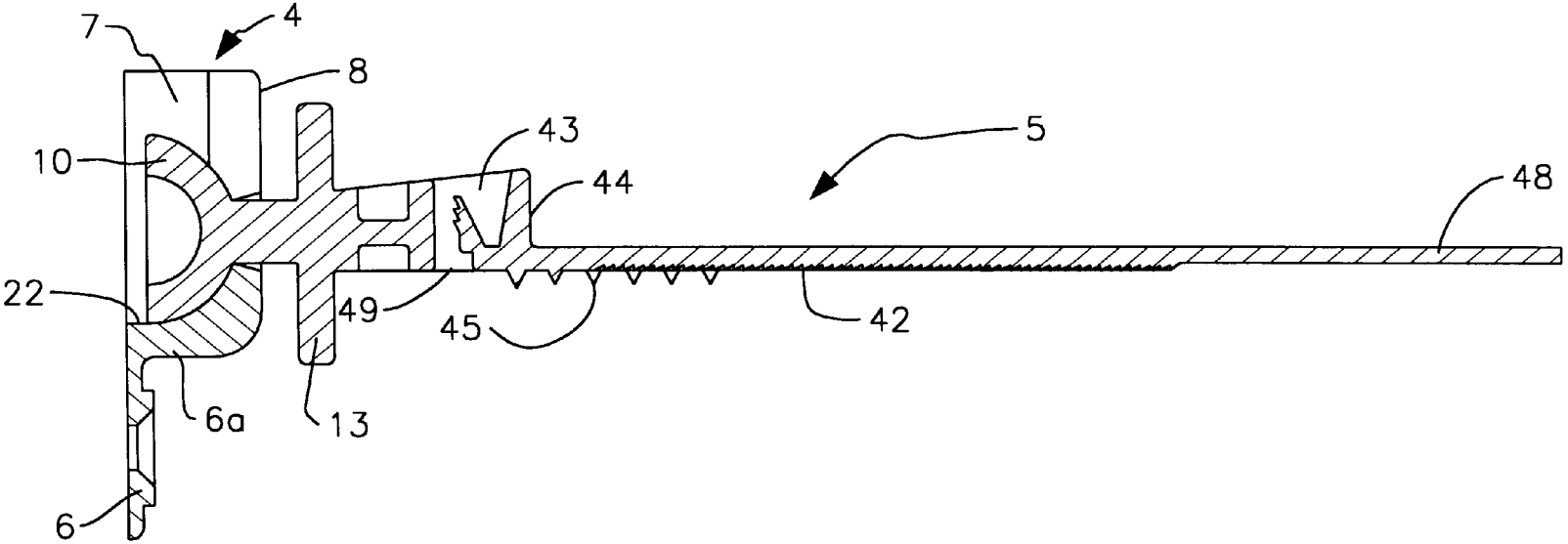
FIG. 11 is a sectional view of the female member of FIGS. 3 and 4 in combination with the male member of FIG. 8.

Referring to FIGS. 9 to 11, there is illustrated an alternative construction of male member indicated generally by the reference numeral 5 for use in conjunction with the female member of FIGS. 3 and 4, thus the female member is identified by the reference numeral 4 and parts similar to those described with reference to the previous drawings are identified by the same reference numerals. In this embodiment there is provided a strap 41 on the end of the shank 11 which strap 41 incorporates teeth 42, illustrated more clearly in FIG. 10, which are adapted to engage a strap retaining lug or spigot 43 mounted within a buckle 44. Net gripping projections 45 project outwardly of the same side of the strap 41 as the teeth 42 to grip a net cord when the strap 41 is secured to the net. This prevents sliding movement of the strap 41 on the net. Figure grip ribs 47 project outwardly at each side of the buckle 44. FIG. 11 shows the male member 5 in engagement with the female member 4 illustrating the ball and socket joint formed between the bulbous head 23 of the male member 5 and the arcuate surface 22 of the socket 7. In use, to secure the male member 5 to the net a free end 48 of the strap is led around a net cord at the edge of a net and delivered up through an eye 49 of the buckle 44 as indicated by the arrows in FIG. 11, the teeth 42 engaging the spigot at 43 to securely fix the male member 5 on the net.

Figure 12:
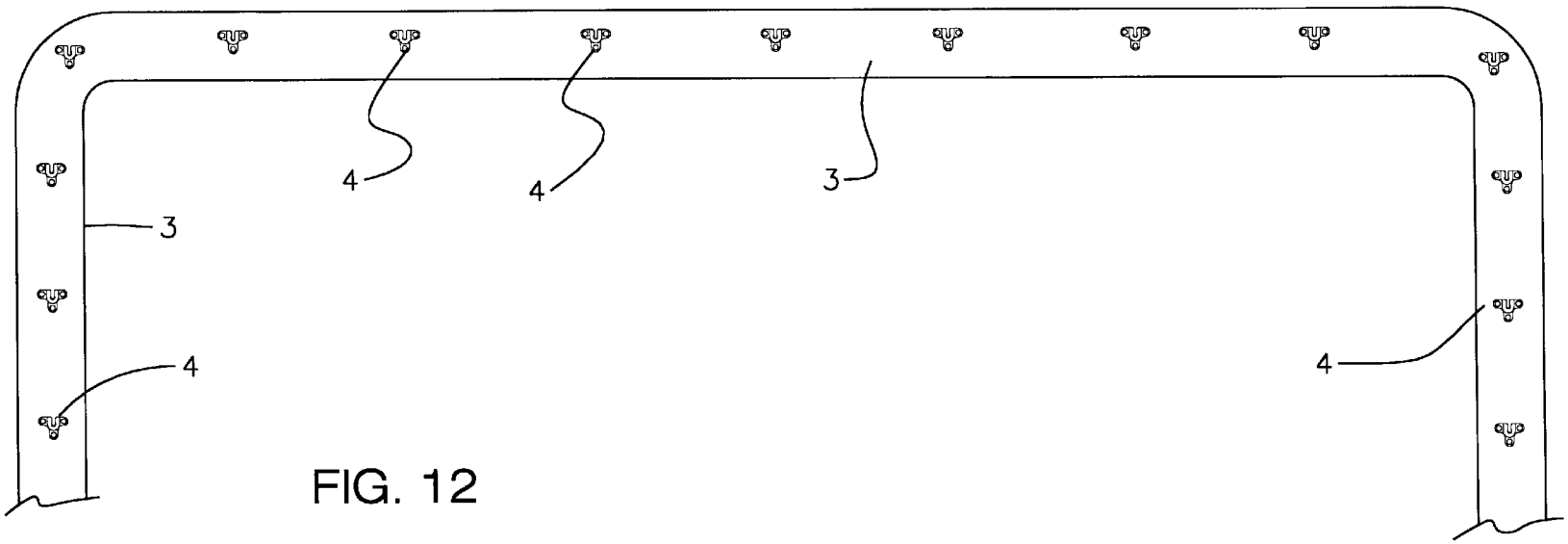
FIG. 12 is a rear elevational view of a soccer goalpost with a set of female members mounted thereon.
Figure 13:
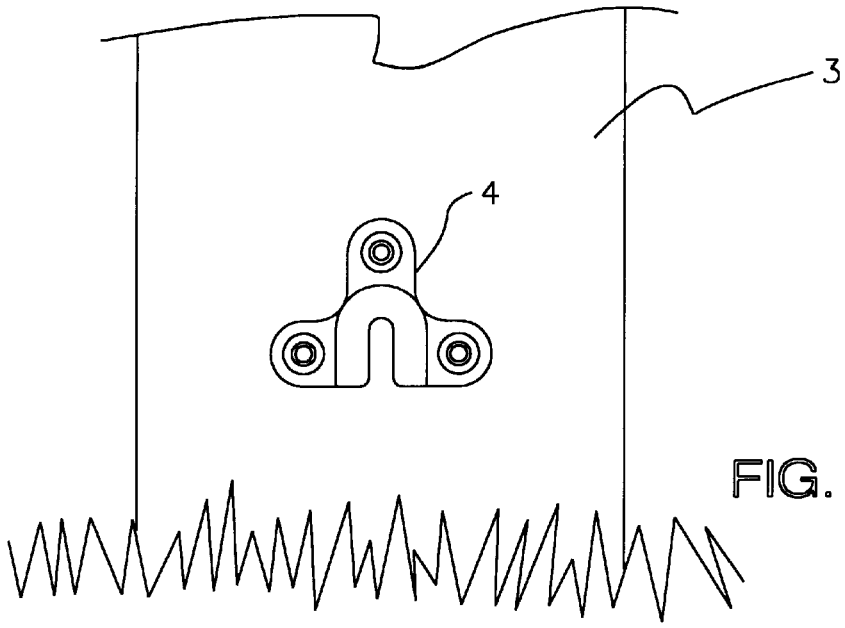
FIG. 13 is a detail rear elevational view of a bottom end of an upright of the goalpost; showing the mounting arrangement for the lowermost female member.
Figure 14:
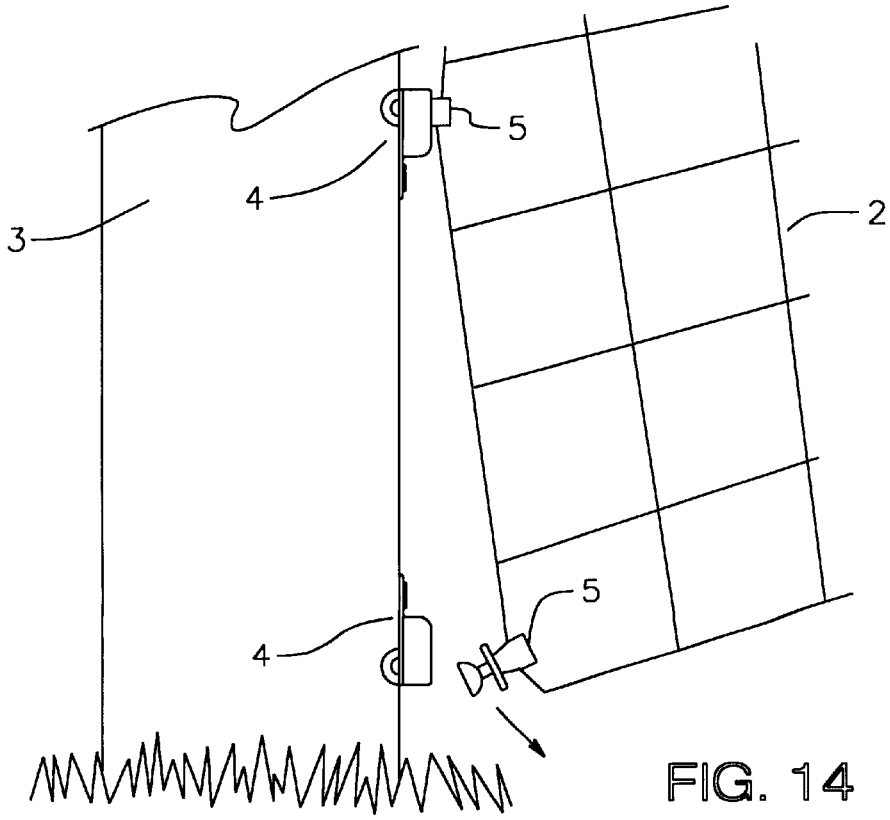
FIG. 14 is a detail side elevational view of the bottom end of the upright showing the attachment of a net to the upright using net fixing devices accordingly to the invention.

FIG. 12 shows a set of female members 4 mounted spaced-apart on the goalpost 3 for supporting the net 2. FIGS. 13 and 14 shows a bottom end of an upright of the goalpost 3. It will be noted that the lowermost female member 4 mounted on the upright 50 is attached upside-edown to retain the net 2 securely at the bottom end of each upright 50. As can be seen in FIG. 14 the lowermost edge of the net to is stretched downwardly to engage the lowermost male member 5 with the lowermost female member 21 on the upright 50, thus keeping the net taut.

It will be noted that the term goalpost as used throughout this Patent Specification is taken to mean any goal frame or part thereof for supporting a net.

Figure 16:
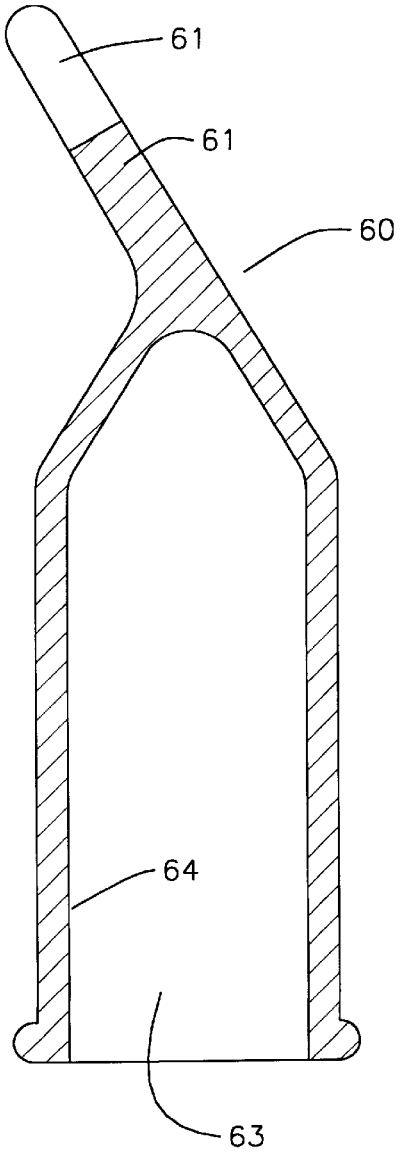
FIG. 16 is a sectional elevational view of the holder of FIG. 15.
Figure 15:
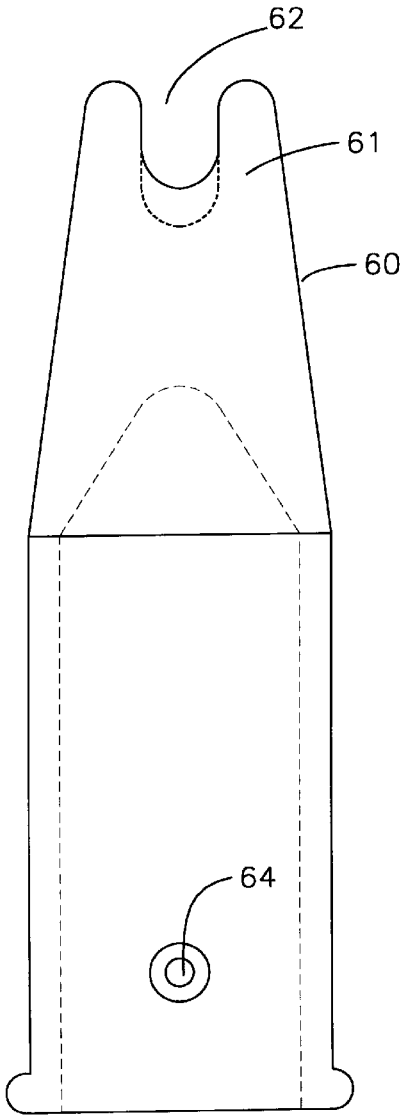
FIG. 15 is an elevational view of a holder for mounting the male members on the female members.

Referring to FIGS. 15 and 16 there is shown a holder 60 for engaging and releasing the male member 5 and female members 5. The holder 60 has a forked head 61 with a slot 62 for engaging the male member 40. A socket 63 is provided in the holder 60 for mounting the holder on a pole or the like for example for engaging and releasing the male and female members along an overhead crossbar of the goalpost. An opening 64 for a locking screw is provided in a sidewall of the socket 63.

Typically, in use a kit will be provided with a polarity of the net fixing devices sufficient for mounting a net on a goalpost or more usually formatting two nets and two goalposts. Ideally, one of the holders 60 is included with each kit.

It will be appreciated that while the embodiments describe fixing devices or connectors for attaching a net to a goalpost it is envisaged that the connectors may be used in other applications. For example, the connectors could be used for attachment of other netting to a support structure. Further, the connectors could be used for mounting covers and the like such as tarpaulins on supports or trailers for example.

The invention is not limited to the embodiments hereinbefore described which may be varied in both construction and detail.

What is claimed is:

1. A net fixing device for goalposts and other structures used in games comprising:

a male member and a cooperating female member, one member for permanent fixing to the goalpost and the other for fixing to the net;

wherein the female member comprises a base plate mounted to a body member, the body member incorporating a socket with a spherical concave inner surface, the female member having an open elongate slot in the body member projecting inwardly of a mouth of the socket and extending to the inner surface, the male member comprising a shank for engaging the slot of the female member and terminating in a bulbous head having a spherical convex outer surface for engagement of the inner surface of the socket, the shank including attachment means for engagement with a net.

2. A device as claimed in claim 1 wherein the male and female members form a ball and socket joint when the male and female members are interengaged.

3. A device as claimed in claim 1 wherein a flange is provided on the shank in a spaced-apart relationship from the head, said flange being of greater width than the slot, a portion of the shank between the head and the flange being engagable with the slot.

4. A device as claimed in claim 1 wherein the male member is adapted to produce an interference fit with the female member.

5. A device as claimed in claim 1 wherein the attachment means is releasable.

6. A device as claimed in claim 3 wherein the attachment means used to connect the shank to the net is a length of cord extending outwardly from the shank.

7. A device as claimed in claim 1 wherein the attachment means is lockable on the net.

8. A device as claimed in claim 10 wherein the attachment means used to connect the shank to the net is a flexible strap incorporating strap locking means.

9. A device as claimed in claim 8 wherein the strap locking means comprises a buckle mounted at an inner end of the shank, the buckle having an eye for through passage of a free end of the strap, a strap retaining lug mounted within the eye for engagement with complementary teeth on the strap when the strap is drawn through the eye of the buckle.

10. A device as claimed in claim 8 additionally comprising net gripping means on the strap.

11. A device as claimed in claim 10 wherein the net gripping means comprises grip projections on the strap which are engagable with the net when the strap is mounted on the net.

12. A device as claimed in claim 1 additionally comprising finger grip means on the shank.

13. A device as claimed in claim 12 wherein the finger grip means comprises a plurality of upstanding ribs on the shank.

14. A net mounting kit comprising.

a plurality of net fixing devices, each net fixing device including:

a male member and a cooperating female member, one member for permanent fixing to the goalpost and the other for fixing to the net;

wherein the female member comprises a base plate mounted to a body member, the body member incorporating a socket with a spherical concave inner surface, the female member having an open elongate slot in the body member projecting inwardly of a mouth of the socket and extending to the inner surface, the male member comprising a shank for engaging the slot of the female member and terminating in a bulbous head having a spherical convex outer surface for engagement of the inner surface of the socket, the shank including attachment means for engagement with a net.

15. A net mounting kit as claimed in claim 14 which further includes a holder having means to engage and support one of the male members of the net fixing device to engage the male member with or release the male member from the female member.

16. A net mounting kit as claimed in claim 15 wherein the holder has a forked head for engagement with the shank of the male member.

17. A net mounting kit as claim in claim 15 wherein the holder has a socket for mounting the holder on a pole.

18. A net fixing device for goalposts and other structures used in games comprising:

a male member and a cooperating female member, one member for permanent fixing to the goalpost and the other for fixing to the net;

wherein the female member comprises a base plate mounted to a body member, the body member incorporating a socket with a spherical concave inner surface, the female member having an open elongate slot in the body member projecting inwardly of a mouth of the socket and extending to the inner surface, the male member comprising a shank for engaging the slot of the female member and terminating in a bulbous head having a spherical convex outer surface for engagement of the inner surface of the socket, the shank including attachment means for engagement with a net;

wherein a flange is provided on the shank in a spaced-apart relationship from the head, said flange being of greater width than the slot, a portion of the shank between the head and the flange being engagable with the slot;

wherein the shank of the male member is adapted to produce an interference fit with the slot of the female member;

wherein the attachment means is releasable;

wherein the attachment means used to connect the shank to the net is a length of cord extending outwardly from the shank;

wherein the attachment means is lockable on the net; and wherein the attachment means used to connect the shank to the net is a flexible strap incorporating strap locking means, the strap locking means comprises a buckle mounted at an inner end of the shank, the buckle having an eye for through passage of a free end of the strap, a strap retaining lug mounted within the eye for engagement with complementary teeth on the strap when the strap is drawn through the eye of the buckle, net gripping means on the strap, the net gripping means comprising grip projections on the strap which are engagable with the net when the strap is mounted on the net, and finger grip means formed on the shank and comprising a plurality of upstanding ribs on the shank.

* * * * *